US006044500A

United States Patent [19]

Madsen et al.

[11] Patent Number: 6,044,500

[45] **Date of Patent: *Apr. 4, 2000**

[54] FLUSHING CISTERN

[75] Inventors: Ib Madsen, Akirkeby; Keld A. Nielsen, Ronne, both of Denmark

[73] Assignee: Bornholms Plastvarefabrik ApS, Klemensker, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/954,726

[22] Filed: Oct. 20, 1997

Related U.S. Application Data

[63] Continuation of application No. 08/583,111, filed as application No. PCT/DK94/00286, Jul. 14, 1994, abandoned.

[30] Foreign Application Priority Data

Jul. 16, 1993 [DK] Denmark ..... 0852/93

[51] Int. Cl.[7] ..... E03D 1/14

[52] U.S. Cl. ..... 4/325

[56] References Cited

U.S. PATENT DOCUMENTS

| | | | |
|---|---|---|---|
| 614,648 | 11/1998 | D'Este et al. . | |
| 978,914 | 12/1910 | Madden . | |
| 2,883,675 | 4/1959 | Hartman, Jr. . | |
| 3,172,129 | 3/1965 | Fulton et al. . | |
| 3,320,622 | 5/1967 | Wustner . | |
| 3,812,545 | 5/1974 | Lanahan . | |
| 3,996,629 | 12/1976 | Riedel | 4/324 |
| 5,259,074 | 11/1993 | Battle | 4/325 |

FOREIGN PATENT DOCUMENTS

| | | | |
|---|---|---|---|
| 2275935 | 9/1994 | United Kingdom | 4/395 |

*Primary Examiner*—Charles E. Phillips
*Attorney, Agent, or Firm*—Pillsbury Madison & Sutro LLP

[57] ABSTRACT

A flushing cistern includes a reservoir with an outlet opening, the opening and closing of which is controlled by a cistern bell. The cistern bell is connected to an activator for lifting the cistern bell when the flushing is initiated. The cistern bell has a cavity and a circumferential seal cooperating with the area about the outlet opening in the reservoir. At least a portion of the cavity in the cistern bell forms a buoyancy-adjusting chamber which is open downwardly inside the seal and communicates upwardly with a control, through an air-escape pipe.

2 Claims, 2 Drawing Sheets

FLUSHING CISTERN

This application is a continuation of Ser. No. 08/583,111 Apr. 19, 1996 abandoned and claims benefit of international application PCT/DK94/00286 filed Jul. 14, 1994.

TECHNICAL FIELD

The invention relates to a flushing cistern comprising a reservoir with an outlet opening, the opening and closing of which is controlled by means of a cistern bell connected to an activating means for lifting the cistern bell when the flushing is initiated, the cistern bell comprising a cavity and a circumferential sealing means co-operating with the area about the outlet opening in the reservoir, whereby at least a portion of the cavity in the cistern bell forms a buoyancy-adjusting chamber being open downwardly inside the sealing means and upwardly communicating with a control means through an air-escape pipe.

BACKGROUND ART

It is known to provide flushing cisterns with two or more flushing volumes, which according to the prior art is allowed either by readjusting the filling level of the rinsing fluid in the cistern tank or by the lift of the bell moving up and downwards being adjustable. This requires, however, additional equipment and in fact it is simultaneously necessary to alter the lifting speed of the bell, too, the latter requiring that the user become familiar with the change.

U.S. Pat. No. 3,812,545 discloses a flushing cistern in which the cavity of the cistern bell is in open connection with a vertically extending air escape pipe carrying an adjustable air escape valve at its upper end inside the reservoir.

SUMMARY OF THE INVENTION

The object of the present invention is to simplify the cistern in such a manner that it is easy for the user to alter the flushing volume without involving a change of the usual procedure.

The flushing cistern according to the present invention is characterised in that the control means is arranged outside the reservoir for manual activation, and that an adjustable stopping means is provided for the lift of the cistern bell.

As a result a flushing cistern is provided by means of which the water consumption can be optimized while the user can easily alter the flushing volume at any time. At the installation of the flushing cistern or parts thereof, the flushing volume is adjusted to the lowest possible level in accordance with the local standard regulations, i.e. approximately 3 liters, by activating the control means so that the flow of air through the air escape pipe is at a maximum in use, and then followed by adjusting the stopping means so that the lift of the cistern bell corresponds to the maximum flushing volume. After the initial adjustment of the minimum flushing volume, the flushing volume is easily controlled according to the requirement by an activation of the control means. The control of the flushing volume is easily done by the user during ordinary use of the toilet in question.

When the bell is in the lowermost position, the cavity is empty because possible, previously present fluid has already flown out more or less quickly through the opening at the bottom of the cavity and then through the outlet opening of the reservoir. When the bell is then lifted into abutment with the stopping means by means of the lifting means which is often just a lever, the flushing fluid immediately starts to flow out of the reservoir through the outlet opening below the sealing means of the cistern bell. When the control means is adjusted so that the air-escape pipe is open, some of the flushing fluid flows into the buoyancy-adjusting chamber in the cistern bell through the downward opening thereof. The resulting effect on the buoyancy of the cistern bell is such that the cistern bell becomes heavier and is forced to return faster to and enter the lowermost position than when the latter cavity remains empty. A complete closing of the air-escape pipe to the buoyancy-adjusting chamber prevents the flushing fluid from flowing into the cavity due to the presence of the air confined therein. When the cistern bell is activated, the flushing volume is then at a maximum because the cistern bell only slowly returns to its lower closing position.

By the invention it is possible for the user at any time to easily carry out an adjustment to more than two flushing volumes by means of the same control means when the means for closing the air-escape pipe can enter a number of positions corresponding to the desired number of flushing volumes. It should in this connection be noted that the opening size of the air-escape pipe is of vital importance for the achievable flushing volume. A narrow opening allows a larger flushing volume than a large opening. In other words, it is in practise possible in advance to obtain an adjustment in principle to any desired minimum achievable flushing volume by delivering air-escape pipes or hoses of varying sizes, and for toilets of a varying pan size and therefore with varying requirements to the minimum flushing volume it is thus possible to deliver a set of air-escape pipes of a varying opening where each opening is adapted to a predetermined toilet or flushing cistern size. The maximum flushing volume can also be adjusted by allowing a narrow opening to remain open when the control means is activated for maximum flushing volume.

In connection with a flushing cistern where the activating means comprises a lever with a gripping button placed outside the reservoir, a particularly simple and practical embodiment is according to the invention obtained when at least a portion of the air-escape pipe extends through the interior of the lever to a control means provided in the gripping button.

BRIEF DESCRIPTION OF THE DRAWINGS

Various embodiments of the invention are described in greater detail below with reference to the accompanying drawings, in which.

BEST MODE FOR CARRYING OUT THE INVENTION

Figure 1:
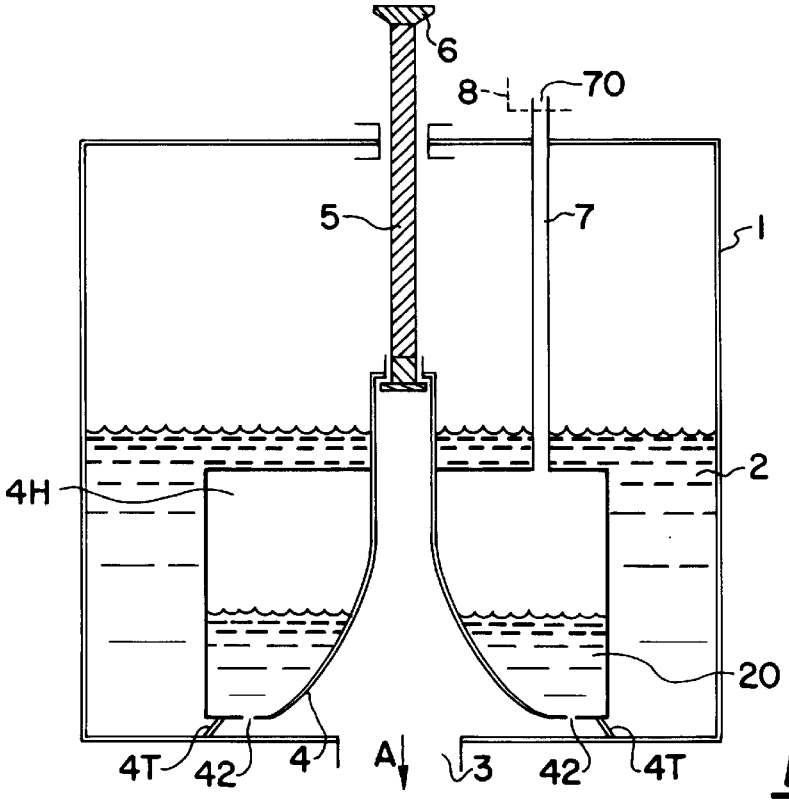
FIG. 1 is a diagrammatic, vertical, sectional view through an embodiment of a flushing cistern according to the invention.

In FIG. 1 of the drawing a flushing cistern is designated 1. The flushing cistern contains a flushing fluid 2 which is water in practice when it is a toilet cistern. When a cistern bell 4 with a downward rim sealing 4T is lifted, the flushing fluid 2 passes therebelow and flows out through an outlet opening 3 in a direction indicated by an arrow A. The cistern bell 4 is shown with a tight outer jacket and an inner funnel-shaped wall which together define a cavity 4H forming a buoyancy-adjusting chamber. The bell 4 is lifted by means of a lever 5 with an upper gripping button 6, the lever extending through an opening with a relatively large sectional area in the top of the cistern bell. This relatively large upper opening communicates openly with the interior of the funnel-shaped wall and is, as indicated, provided with an opening space between the cistern bell 4 and the lever 5 being so large that excess flushing fluid is allowed to flow out therebetween. As a result, an excessive filling with flushing fluid of the reservoir of a flushing cistern is prevented.

In order to obtain the advantages of the invention, there is provided a suitable, upwardly projecting air-escape pipe 7 with an opening 70. The opening 70 is completely or partially closable by means of an indicated suitable blocking means of any known type. One or more flow openings 42 are provided in the lower portion of the bell, the flow openings directly facing the flow zone of flushing water 2. When a lifted bell 4 during an initiated flushing moves downwards due to the gravitational effect so as to enter the position shown in FIG. 1, the flushing fluid 2 flows into the cavity 4H, cf. the reference numeral 20, provided the opening 70 of the air-escape pipe 7 is open. The flushing fluid 20 causes the bell 4 to move faster downwards with the result that the flushing is reduced compared to the situation without openings 42 or with a closed opening 70.

Figure 2:
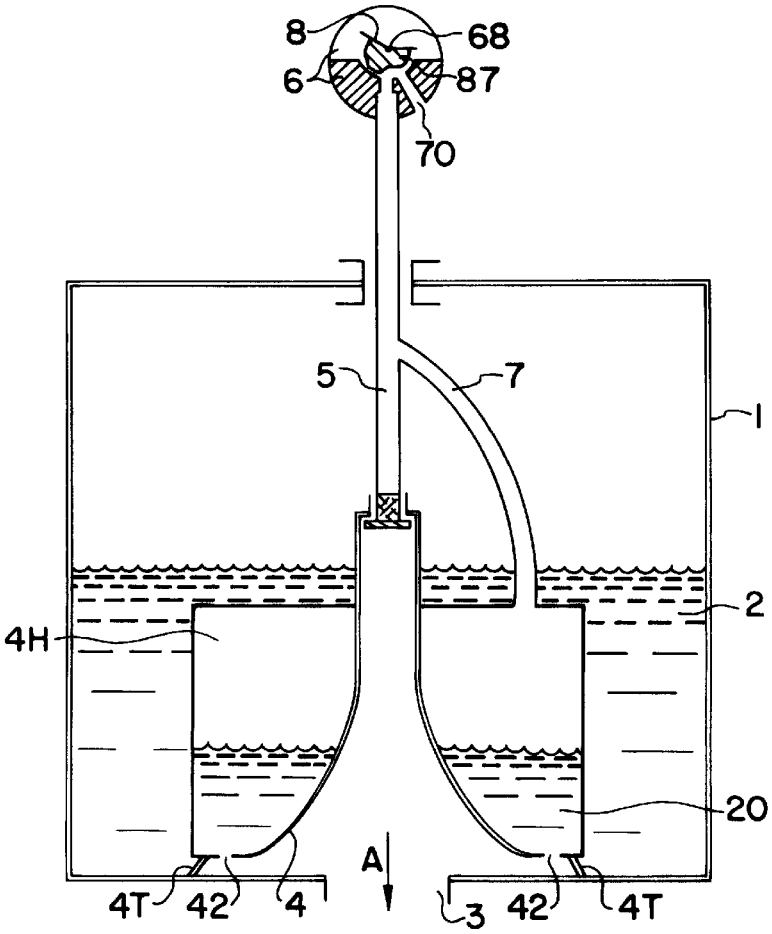
FIG. 2 is a diagrammatic, sectional view of a second embodiment of the invention corresponding to the sectional view in FIG. 1.

FIG. 2 of the drawing shows a second embodiment of the invention. Here the air-escape pipe 7, such as a hose, extends into an inner hollow space formed in the lever 5 in the longitudinal direction and ending at 70. The opening at 70 is completely or partially closeable by means of a blocking disk 87 rotatable about a pivot and arranged in the gripping button 6. The blocking disk can be adjusted by means of a small gripping means 8. In the position shown, the opening 70 is opened to a maximum. The opening 70 is completely or partially closed by turning the gripping means 8 counterclockwise, optionally with marked intermediary positions.

Figure 3:
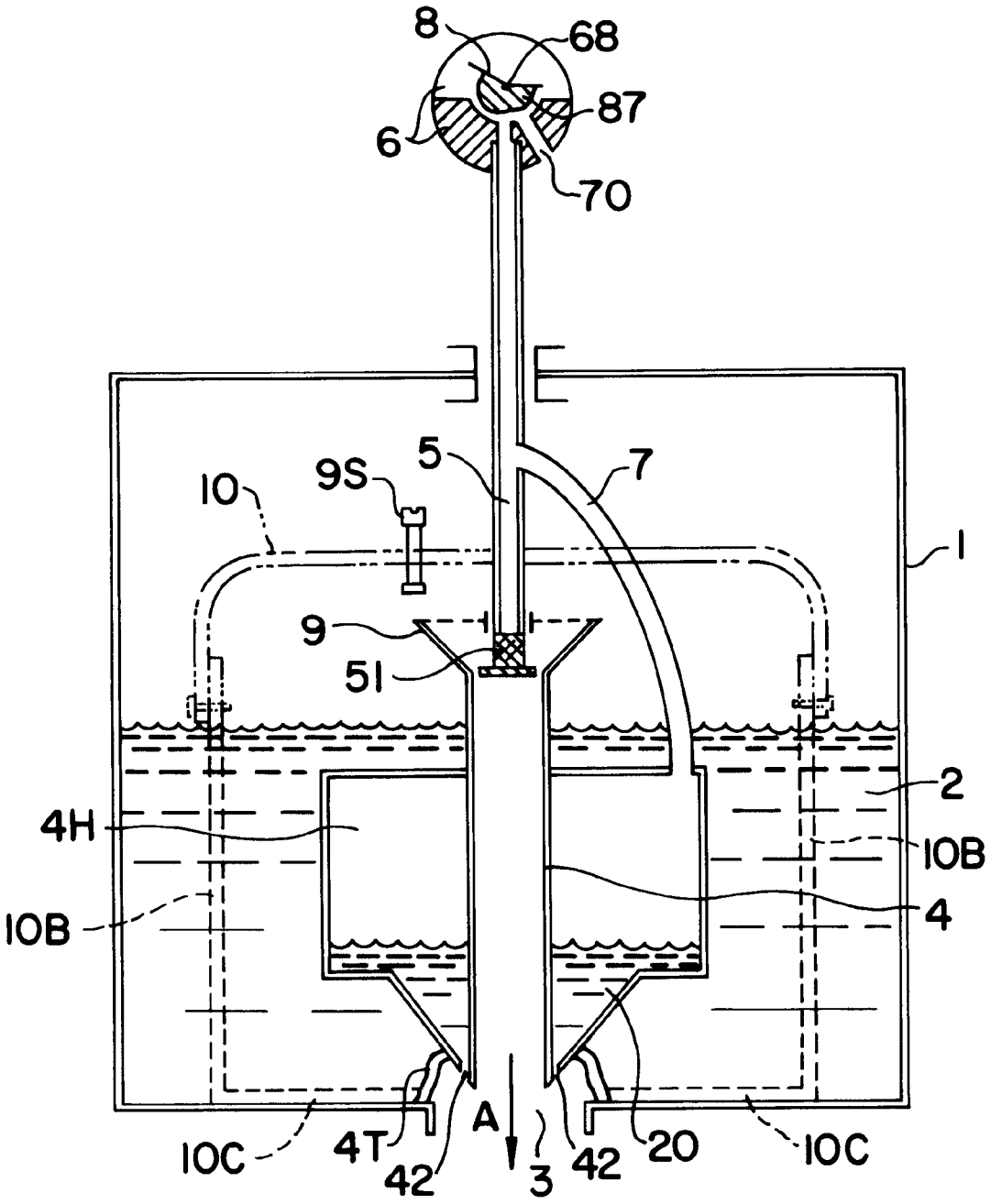
FIG. 3 is a diagrammatic, vertical, sectional view of a third embodiment of the invention.

FIG. 3 of the drawing shows a further development of the embodiment of FIG. 2. The upper half is almost identical with the one shown in FIG. 2. The lever 5 is supported by a hoop-shaped means 10 only being indicated and comprising hoop-shaped lower members 10B and 10C. The members 10C are terminated by an annular portion around the opening 3 in such a manner that a bushing not shown with unions not shown can retain the entire bell arrangement inside the cistern through the opening 3 by way of one-hole-mounting and in a manner known per se. In this manner already existing flushing cisterns can be modified by a few measures, whereby a reduced water consumption etc. can be obtained. The hoop members 10B or 10 or both 10B and 10 can be provided with elongated openings, whereby the arrangement can be adapted to cisterns of a varying structural height.

The cistern bell 4 of the embodiment shown in FIG. 3 is thinner, and more free passage is provided for possible, overflowing flushing fluid at the upper end 9 of the bell body 4. When the lever 5 is lifted, the latter upper end 9 abuts an adjustment screw 9S which can limit the volume of the flushing in a manner already described above. Accordingly, the adjustment screw can be used for adjusting the volume to the large flushing, a reduced flushing or both flushings. By using for instance a lower shape of the bell body 4 as indicated in FIG. 3 with the described flow openings 42 to the cavity 4H, the flow conditions for the flushing fluid flowing out imply that the weight and buoyancy of the cistern bell can be mutually adjusted in such a manner that only a low amount of flushing fluid flows upwards both inside the inner wall of the bell body 4 and into the cavity 4H in connection with a large flushing where the air-escape pipe 7 is blocked. As a result, the entire cistern bell can remain floating high up in the water for a long period. When the surface of the flushing fluid decreases so far that the sealing 4T of the semi-floating bell body is close, but has not yet reached the bottom of the cistern, the flow of flushing fluid continues, but the downwardly drawing effect on the various adjacent parts of the bell body 4 by the flushing fluid flowing out stops in such a manner that without closing the outlet opening the remaining amount of flushing fluid flows out while the bell body 4 emerges through the surface of the flushing fluid with the result that a maximum flushing is in fact obtained. Such an adjustment of the weight of the movable parts and such a flow path of the flushing fluid adjacent especially the lower portion of the cistern bell have revealed that the setting position of the adjusting screw 9S in connection with a large flushing is of no particular importance for the volume of the large flushing volume, but the adjusting screw has nevertheless still an effect on the amount of water involved in the low flushing. However, by optionally adjusting the size of the air-escape opening present in the air-escape hose 7 it is possible to adjust one and the same size of reservoir toilets to various requirements to the amount of water, even already when installing in areas presenting limits to the supply of water especially to the volume of the large flushing. When for instance the outlet pipes are narrow, it is obvious that for financial reasons another amount of flushing water is necessary per large flushing than when the outlet pipes have a large opening or when the height of the fall thereof is large.

We claim:

1. A flushing cistern, comprising:

a reservoir with an outlet opening, the opening and closing of which is controlled by a cistern bell connected to an activating means for lifting the cistern bell when flushing of the cistern is initiated;

said cistern bell comprising a cavity and a circumferential sealing means cooperating with an area about said outlet opening of said reservoir, whereby at least a portion of said cavity in said cistern bell forms a buoyancy-adjusting chamber which is open downwardly inside said sealing means and communicates upwardly with a control means through an air-escape pipe;

said control means being arranged outside said reservoir for manual activation; and an adjustable stopping means provided for limiting lifting of said cistern bell, said stopping means being positioned at a level at which buoyancy of said cistern bell in use maintains said cistern bell in abutment with said stopping means when flushing of the cistern is initiated.

2. A flushing cistern, comprising:

a reservoir with an outlet opening, the opening and closing of which is controlled by a cistern bell connected to an activating means for lifting the cistern bell when flushing of the cistern is initiated;

said cistern bell comprising a cavity and a circumferential sealing means cooperating with an area about said outlet opening of said reservoir, whereby at least a portion of said cavity in said cistern bell forms a buoyancy-adjusting chamber which is open downwardly inside said sealing means and communicates upwardly with a control means through an air-escape pipe;

said control means being arranged outside said reservoir for manual activation; and an adjustable stopping means provided for limiting lifting of said cistern bell, said stopping means being positioned at a level at which buoyancy of said cistern bell in use maintains said cistern bell in abutment with said stopping means when flushing of the cistern is initiated, said activating means comprising a lever with a gripping button placed outside said reservoir; and at least a portion of said air-escape pipe extending through the interior of a lever to said control means, which is provided in a gripping button.

* * * * *